United States Patent [19]

Haythornthwaite

[11] Patent Number: 4,702,004

[45] Date of Patent: Oct. 27, 1987

[54] GLASS RAZOR BLADE AND HANDLE

[76] Inventor: James Haythornthwaite, 567 Main Road, Hudson, Quebec J09 1I0, Canada

[21] Appl. No.: 758,465

[22] Filed: Jul. 24, 1985

[51] Int. Cl.[4] ..... B26B 21/14

[52] U.S. Cl. ..... 30/57; 30/50; 30/85; 30/346.5; 30/346.54; 76/DIG. 8

[58] Field of Search ..... 30/32, 50, 57, 85, 346.5, 30/346.51, 346.53, 346.54, 47–49; 76/DIG. 8

[56] References Cited

U.S. PATENT DOCUMENTS

| | | | |
|---|---|---|---|
| 2,325,662 | 8/1943 | Clarke | 30/35 |
| 2,555,214 | 5/1951 | Wallach et al. . | |
| 3,136,056 | 6/1964 | Reymier | 30/47 |
| 3,488,764 | 12/1967 | Welsh | 30/32 |
| 3,543,402 | 12/1970 | Seager | 30/346.53 |
| 3,722,091 | 3/1973 | Gagnon | 30/40 |
| 3,831,466 | 8/1974 | Hicks | 30/346.53 X |
| 3,953,186 | 4/1976 | Howey | 65/51 |
| 4,011,071 | 3/1977 | Siegmund | 65/31 |

OTHER PUBLICATIONS

F. J. Terence Maloney "Glass in the Modern World, A Study in Materials Development", Doubleday Science Series.

*Primary Examiner*—Douglas D. Watts

*Attorney, Agent, or Firm*—Fleit, Jacobson, Cohn & Price

[57] ABSTRACT

A razor (10, 10') is formed entirely of an inexpensive glass material. In one embodiment the razor (10) is formed as a single piece of material which includes a handle portion (14), a blade portion (16) and an arcuate intermediate portion (18) interconnecting the handle and blade portions, with the blade portion being provided with a sharp cutting edge (24). In another embodiment the razor (10') includes a handle (14') and an essentially cylindrical blade (16') received between clamping jaws (26) at one end of the handle, with the blade being provided with opposed cutting edges (24').

2 Claims, 5 Drawing Figures

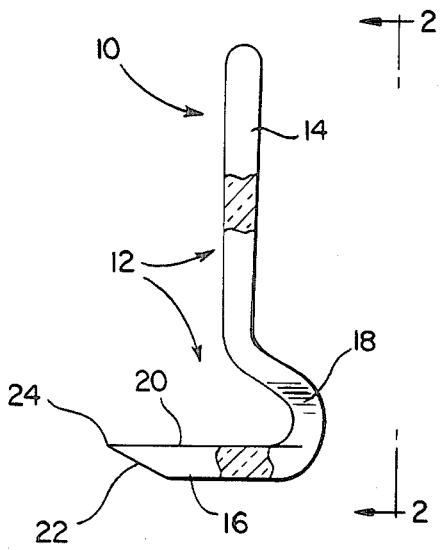
FIG. 1
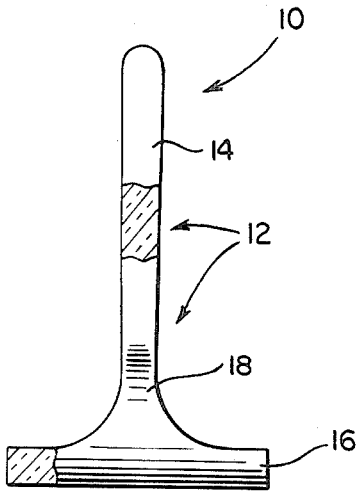
FIG. 2
FIG. 3
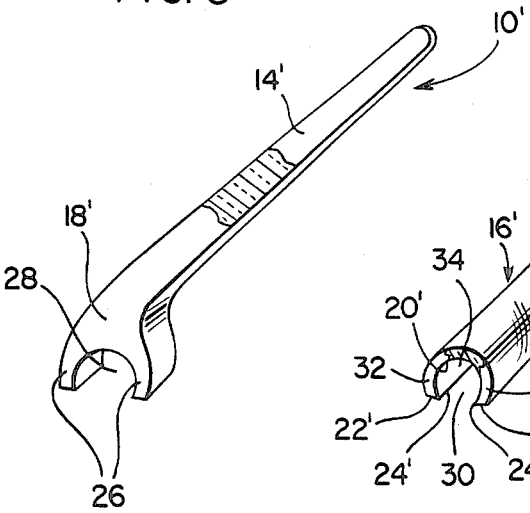
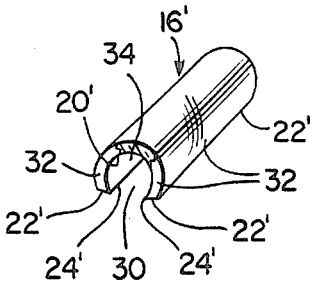
FIG. 4
FIG. 5
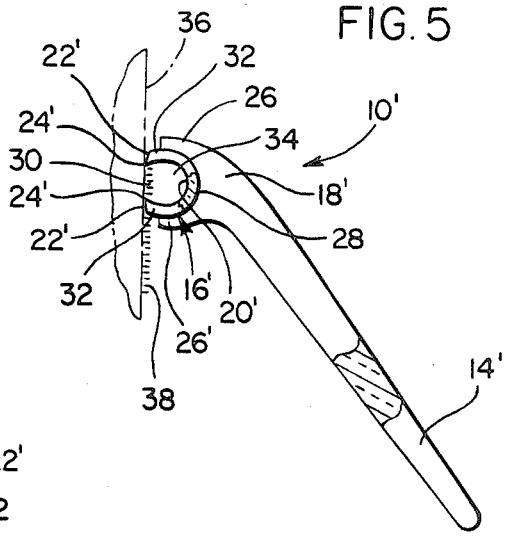

GLASS RAZOR BLADE AND HANDLE

BACKGROUND OF THE INVENTION

1. Field of the Invention

This invention relates to razors, and more particularly to a razor which is formed entirely of a glass material.

2. Description of the Prior Art

Generally, razors are formed of multiple parts, with each razor including at least a handle and a separate blade. The handle may be formed of metal or plastic, or a combination thereof, and at one end terminates in a blade holder for receiving the blade. The blade may be of a disposable type, which can be replaced in the blade holder of the handle, with the handle being reused, or the handle and the blade may both be disposable.

The blade usually is made of metal and is formed with a sharp cutting edge, although other materials, such as glass and ceramic have been proposed. For example, the U.S. Pat. Nos. 2,555,214 to Wallach, 3,953,186 to Howey and 4,011,071 to Siegmund, disclose the use of razor blades formed of glass material. Further, the U.S. Pat. No. 3,543,402 to Seager discloses a razor blade formed of a ceramic material containing aluminum oxide.

Normally, the blade holder of the razor handle receives a single flat blade having a cutting edge on one side (single edge), or having cutting edges on opposite sides (double edge) of the blade. Other razor variations are known in which the blade has other cnfigurations and/or two or more blades are provided. For example, the U.S. Pat. No. 2,325,662 to Clarke discloses a razor in which the blade is of an essentially cylindrical construction with a gap being provided in the blade to define a pair of opposed edge portions provided with respective cutting edges. The U.S. Pat. No. 3,488,764 to Welsh discloses a razor in which a razor handle terminates at one end in a pair of spaced opposed leg portions provided with respective razor blades which project from the leg portions at an angle in essentially opposed relationship to one another. Further, the U.S. Pat. No. 3,722,091 to Gagnon discloses a razor in which a razor handle is provided at one end with an essentially cylindrical blade holder having an axial slot and which receives an elongated rotatable member having a plurality of cutting blades mounted thereon. By rotating the rotatable member, the cutting blades can be selectively positioned to project through the axial slot in the blade holder one at a time.

In general, prior known razors as above described have been subjected to various disadvantages. For example, a razor in which the handle is formed entirely of metal generally is relatively expensive, not only because of the relatively high cost of most metals, but also because the metal which is utilized must be of a type which is resistant to rust and other types of corrosion. The same is true even where the razor handle is formed of a combination of metal and plastic. Further, where the blade is formed of one material and the handle is formed of another material, such as a metal blade in a handle which includes plastic, rinsing the razor during shaving under extremely hot (or extremely cold) water tends to cause different rates of expansion of the blade and the handle, thereby producing variations in the angle between the blade and the handle and reducing the efficiency of the razor during the shaving operation.

In addition, the use of a blade which is separate from the handle is undesirable for various reasons. For example, whiskers or hairs, and/or soap or shaving cream, tend to become embedded in the spaces between portions of the blade and the blade holder of the handle, or coated upon surfaces of the blade holder, making the razor extremely difficult to clean between shaves. This is particularly detrimental where the blade is intended to be disposable and replaced with a new blade periodically, with the handle being reused over an extended period of time, since the whiskers or hairs, and soap and/or shaving cream, tend to become entrenched within the blade holder of the handle. Another disadvantage of the blade and the handle being separate members is that a certain degree of precision is required in the manufacture of both the blade and the handle to ensure that the blade is disposed or receivable in the blade holder of the handle at the proper angle. Further, even where precision in manufacture initially is obtained, since the blade holder of the handle tends to wear during use, eventually the desired precise relationship between the blade and the protective edges of the blade holder deteriorates and the razor loses its shaving efficiency. Where the blade is of the disposable replaceable type, there also is a tendency to insert the new blade the wrong way into the blade holder, causing considerable aggravation to the user. In addition, where the blade is formed of metal, as has been noted above with reference to the use of metal handles, the blade must be formed of a relatively expensive rust-proof material.

Accordingly, a primary purpose of the subject invention is to provide a new and improved razor which is formed of an inexpensive corrosion-resistant material and which is not subject to the disadvantages of prior known razors as discussed hereinabove.

SUMMARY OF THE INVENTION

In genera, a razor in accordance with the invention comprises an elongated handle portion and a cutting blade portion having first and second surfaces which intersect to define at least one sharp cutting edge. The handle portion and the blade portion, including the one sharp cutting edge, all are formed entirely of a glass material.

More specifically, in one embodiment of the invention the handle portion and the blade portion are interconnected by an arcuate intermediate portion, with the handle portion, blade portion and arcuate intermediate portion all forming parts of a single integral body of glass material. Further, the handle portion and the blade portion of the razor extend essentially perpendicular to one another.

In another embodiment of the invention, the elongated handle portion includes a pair of arcuate opposed clamping jaws at one end thereof, the arcuate opposed clamping jaws being integral with the remainder of the handle portion and having spaced opposed ends. Further, the blade portion is of elongated essentially cylindrical construction and is formed with an axially extending gap between spaced opposed ends thereof to define elongated edge portions extending in spaced opposed parallel relationship for the length of the blade portion. The spaced opposed elongated edge portions have respective intersecting surfaces which define first and second opposed sharp cutting edges. The blade portion is removably and rotatably received in the arcuate clamping jaws of the handle portion with the opposed elongated portions and the sharp cutting edges of the blade portion projecting beyond the clamping jaws of the handle portion.

BRIEF DESCRIPTION OF THE DRAWINGS

FIG. 1 is a side elevational view of a first embodiment of a razor in accordance with the invention;

FIG. 2 is a view of the embodiment of the invention shown in FIG. 1, as seen along the line 2—2 in FIG. 1;

FIG. 3 is an isometric view of a handle member of a second embodiment of a razor in accordance with the invention;

FIG. 4 is an isometric view of a blade portion of a razor for use in the razor handle shown in FIG. 3; and FIG. 5 is a side elevational view of the handle and blade portion shown in FIGS. 3 and 4 in assembled relationship.

DETAILED DESCRIPTION

Referring to FIGS. 1 and 2, a razor 10 in accordance with the invention may be formed of a single integral one-piece body 12 formed of a glass material. The body 12 includes an elongated handle portion 14, a blade portion 16 and an arcuate intermediate portion 18 which interconnects the handle portion and the blade portion. The blade portion 16 includes an inner planar surface 20 and a beveled outer surface 22 which intersect to produce a sharp cutting edge 24. The elongated handle portion 14 and the blade portion 16 extend essentially perpendicular to one another and the handle portion is provided with suitably contoured edges to provide a comfortable fit in the hand of the user.

Referring to FIG. 3, another razor 10' in accordance with the invention includes an elongated handle portion 14' and an arcuate portion 18' which terminates in a pair of essentially arcuate clamping jaws 26, with the elongated handle portion, arcuate portion and the arcuate clamping jaws being integrally formed of a glass material. The arcuate clamping jaws 26 define an arcuate blade-receiving recess 28 therebetween. The clamping jaws 26 may be relatively narrow, as shown in FIG. 3, or may be flared outwardly on opposite sides of the handle 14', as desired.

Referring to FIG. 4, a razor blade 16' which may be utilized in the razor handle 14' shown in FIG. 3, also is formed entirely of a glass material. The razor blade 16' is of essentially cylindrical construction, with an internal essentially circular surface 20', and includes an axially extending gap or slot 30 which defines elongated edge portions 32 extending in spaced opposed parallel relationship for the length of the blade. The elongated opposed edge portions 32 include outer beveled surface portions 22' which intersect with the internal circular surface 20' of the blade 16' to define first and second opposed sharp cutting edges 24'. The essentially cylindrical blade 16' also defines an inner hollow area 34 which facilitates cleaning of the blade during and after a shaving operation.

With reference to FIG. 5, the blade 16' is assembled with the handle 14' by sliding the blade into the arcuate recess 28 defined by the clamping jaws 26 of the handle, from one side of the recess. More specifically, the blade 14' is inserted into the recess 28 such that the elongated edge portions 32 of the blade and the cutting edges 24' thereon project beyond the jaws 26. To facilitate insertion of the blade 16' between the clamping jaws 26, outer edges of the blade at the opposite ends thereof may be provided with a slight bevel (not shown).

As the razor 10' is utilized in a shaving operation, by moving the blade 16' over a skin surface 36 of the user's face, one of the cutting edges 24' is in a position for shaving whiskers 38 from the skin surface, and the second cutting edge 24' and the adjacent beveled surface 22' act to guide the razor blade over the skin surface without causing cutting or nicking of the skin surface by the first blade. Further, the second cutting edge 24' and the adjacent beveled surface 22', which travel in advance of the first cutting edge 24' during each shaving stroke, tension the skin surface 36 between the two cutting edges 24', to facilitate the shaving operation and to guarantee a repetitive cutting cycle. The second cutting edge 24' and the adjacent beveled surface 22' also initially pess the whiskers 38, which may not be necessarily erect (e.g., perpendicular) with respect to the skin surface 36, down into a bent-over position (not shown) against the skin surface in the direction of advancement, whereupon the whiskers subsequently spring outward into an erect position with respect to the skin surface for cutting by the first cutting edge 24', thereby giving a closer and smoother cut.

In the embodiment of the invention shown in FIGS. 3, 4 and 5, when one of the cutting edges 24' of the blade 16' becomes dull, the blade can be removed from the handle clamping jaws 26 and reinserted between the clamping jaws in an inverted position such that the second cutting edge is in a position for shaving, with the first cutting edge and the adjacent beveled surface 22' then functioning as above described. Further, the blade 16' can be rotated prior to, or during use, to position the blade and thus the cutting edges 24' thereof at the proper shaving angle for the individual user. Alternatively, if a fixed alignment were desired, a tongue-and-groove or other alignment aid (not shown) could be employed.

Preferably, each of the razors 10 and 10' in accordance with the invention is formed of a type of glass material which is relatively inexpensive, such that the razors can be produced in large quantities at minimum cost. At the same time, the glass material also should be capable of being ground and polished to a sharp edge, and should possess a certain degree of resistance to thermal shock and stress cracking because of the necessity of the razors being plunged into and/or rinsed in hot (or cold) water during use. For example, the razors 10 and 10' may be formed of a glass material such as a borosilicate glass or an optical soda lime glass.

Further, the manufacture of the razors 10 and 10' may be accomplished in suitable sectional mold presses, not shown. Following molding, the razor 10, and the handle 14' and the blade 16' of the razor 10', should be subjected to an annealing operation in which they are reheated to a temperature at which internal stresses can be relieved, and at which they still are capable of being self supporting, such as 550° C. The articles 10, 14' and 16' then should be cooled relatively slowly, in a known manner, to avoid internal stress cracking therein. After the articles 10, 14' and 16' have been annealed, the articles also may be subjected to a flame-polishing operation in which the articles are exposed to a plurality of gas flame jets, to remove molding lines and provide the articles with smooth surfaces.

Referring to the razor 10 shown in FIGS. 1 and 2, by way of example, the beveled edge 22 on the blade portion 16 then can be formed by mechanical grinding, as for example with a suitable grinding wheel or flat disc, and/or with a suitable abrasive. Similarly, the ground beveled edge 22 then can be subjected to a mechanical polishing operation, as for example with a suitable polishing wheel or flat disc, and/or with a suitable polishing powder, to provide a smooth surface on the beveled edge which will glide over the face of the user with minimal friction, normally less than that which is present between a user's skin and a metal blade, and to refine and improve the sharpness of the resultant cutting edge 24 formed between the beveled edge and the inner planar surface 20 of the razor 10. The inner planar surface 20 of the razor 10 also may be ground and polished, to enhance the sharpness of the cutting edge 24, if so desired. The beveled surfaces 22' and the cutting edges 24' on the blade 16' shown in FIGS. 4 and 5 may be formed in a similar manner.

In summary, a new and improved razor, such as the razor 10 or 10', has been provided which is formed entirely from an inexpensive material, glass. The razor 10 or 10' is relatively easy to manufacture, and precision control between the blade and a blade holder of the razor during manufacture, is not necessary. Further, neither of the razors 10 or 10', being formed entirely of glass material, is subject to rusting or changes in blade angle as a result of differences in expansion of their respective parts when subjected to extremely hot (or cold) temperature. Since the razor 10 is formed of a single piece of material, and since the blade 16' of the razor 10' can be utilized in either direction, the problem of inserting a blade into the razor in the wrong direction also is eliminated. Further, the razor 10, being formed in one piece, is not subject to clogging and can be readily cleaned. In this connection, while the razor 10' is formed in two parts, as a result of the cylindrical construction of the blade 16', with the relatively large internal recess 34 therein, the razor 10' also is not subject to clogging and, in any event, readily can be cleaned for reuse. Being formed of the relatively inexpensive glass material, both of the razors 10 and 10' also may be thrown away and replaced after several uses, if so desired.

What is claimed is:

1. A razor, which comprises:

an elongated handle portion; and a cutting blade portion having first and second opposed sharp cutting edges;

the elongated handle portion and the cutting blade portion, including the first and second opposed sharp cutting edges, all being formed entirely of a glass material;

the elongated handle portion including a pair of arcuate opposed clamping jaws at one end thereof, the arcuate opposed clamping jaws being integral with the remainder of the handle portion and having spaced outer ends; and the blade portion being of elongated essentially cylindrical construction and being formed with an axially extending slot between spaced opposed ends thereof to define elongated edge portions extending in spaced opposed parallel relationship for the length of the blade portion, the spaced opposed elongated edge portions having respective intersecting surfaces which define the first and second opposed sharp cutting edges thereon, the blade portion being removably received in the arcuate clamping jaws of the handle portion with the opposed elongated portions and the sharp cutting edges thereon projecting beyond the clamping jaws of the handle portion.

2. The razor as recited in claim 1, in which the blade portion is rotatable in the arcuate clamping jaws.

* * * * *